US005868106A

United States Patent [19]

Poropatic et al.

[11] Patent Number: 5,868,106

[45] Date of Patent: Feb. 9, 1999

[54] CYLINDERHEAD OF A MULTICYLINDER INTERNAL COMBUSTION ENGINE

[75] Inventors: Stjepan Poropatic, Steinenbronn; Ullrich Weiss, Stuttgart, both of Germany

[73] Assignee: Daimler-Benz AG, Stuttgart, Germany

[21] Appl. No.: 957,682

[22] Filed: Oct. 24, 1997

[30] Foreign Application Priority Data

Oct. 25, 1996 [DE] Germany ..... 196 44 409.8

[51] Int. Cl.[6] ..... F02F 1/36

[52] U.S. Cl. ..... 123/41.82 R

[58] Field of Search ..... 123/41.82 R, 193.5, 123/41.74

[56] References Cited

U.S. PATENT DOCUMENTS 3,818,878 6/1974 Zarubce ..... 123/41.82 R

FOREIGN PATENT DOCUMENTS 56148647 11/1981 European Pat. Off. .

799128 6/1936 France ..... 123/41.82 R 2580335 10/1986 France .

42 22 801 5/1995 Germany .

*Primary Examiner*—Noah P. Kamen

*Attorney, Agent, or Firm*—Klaus J. Bach

[57] ABSTRACT

In a cylinder head of a multi-cylinder internal combustion engine having bottom-top and side walls defining therebetween a cooling water space and including for each cylinder a number of intake and exhaust passages arranged around a central well for receiving a spark plug or a fuel injector, which all extend through the cooling water space through which cooling water flows generally in a longitudinal direction of the cylinder head, the bottom wall has for each cylinder cooling water supply openings disposed at a side of the cooling space so as to generate, adjacent the bottom wall, a transverse flow, and transverse projections are arranged ahead of each cylinder so as to extend upwardly for lifting the longitudinal cooling water flow above the transverse cooling water flow.

5 Claims, 2 Drawing Sheets

CYLINDERHEAD OF A MULTICYLINDER INTERNAL COMBUSTION ENGINE

BACKGROUND OF THE INVENTION

The invention resides in a cylinder head of a multi-cylinder internal combustion engine having bottom and top and side walls delimiting a cooling water space through which intake and exhaust passages extend and for each cylinder a recess for receiving a spark plug or an injector.

Such a cylinder head is described for example in DE C 42 22 801 wherein a cooling water space is divided by a dividing wall into an upper and a lower cooling water chamber. In the upper cooling water chamber, a longitudinal cooling water flow is maintained whereas, in the lower cooling water chamber, a transverse cooling water flow through the cylinder head is maintained in order to achieve a particularly good cooling effect for the walls adjacent the combustion chambers. It has been found, however, that the cooling water may remain stagnant in areas adjacent the divider wall, which detrimentally affects the cooling particularly of the exhaust passages and the recesses receiving the spark plugs or the fuel injectors.

It is therefore the principal object of the present invention to provide a cylinder head with water cooling passages formed therein such that particularly the cooling of the recesses receiving the spark plugs or the injectors and the exhaust passage is improved.

SUMMARY OF THE INVENTION

In a cylinder head of a multi-cylinder internal combustion engine having bottom-top and side walls defining therebetween, a cooling water space and including for each cylinder, a number of intake and exhaust passages arranged around a central well for receiving a spark plug or a fuel injector, all extending through the cooling water space through which cooling water flows generally in a longitudinal direction of the cylinder head, the bottom wall has for each cylinder cooling water supply openings disposed at a side of the cooling water space so as to generate adjacent the bottom wall a transverse flow and transverse projections are arranged ahead of each cylinder and extending upwardly so as to lift the longitudinal cooling water flow above the transverse cooling water flow.

In the arrangement according to the invention, the walls of the cylinder head adjacent the combustion chamber are intensely cooled, like in the arrangement shown in the prior art, by a transverse cooling water flow. However, the transverse cooling water flow is not separated by a divider wall from the longitudinal cooling water flow so that one flow layer engages the other along a separation area so that stagnant water areas cannot develop between the two cooling water flows. The projections deflect the longitudinal cooling water flow from the cylinder head bottom whereby interference with the transverse flow which detrimentally affect the heat removal, is avoided.

Preferably, there are water admission openings between adjacent intake and exhaust passages through which the transverse flow is admitted and, in order to intensely cool the recesses a flow guide structures is disposed ahead of each recess in the direction of the longitudinal coolant flow. The flow guide structure conducts the longitudinal flow and at least the cooling water of the transverse flow, which flows through the admission openings between the exhaust passages, around the walls forming the recess. In this arrangement, the fact is utilized that, in an engine with four valves per cylinder, the exhaust valves have generally a smaller diameter than the intake valves so that the admission openings between the exhaust passages can have a larger cross-section than the admission opening between the intake valves. The larger cooling water flow of the transverse cooling water flow arrangement is directed by the guide structure onto the recess walls. The guide structure may be molded onto an exhaust passage.

In order to keep the transverse cooling water flow in the vicinity of the cylinder head bottom, a plate may be provided in the cooling water space above the projection, which plate surrounds the recess and extends parallel to the cylinder head bottom. The plate prevents that the cooling water of the transverse flow readily enters the upper cooling water space.

The invention will be described in greater detail on the basis of the accompanying drawings.

DESCRIPTION OF A PREFERRED EMBODIMENT

Figure 1:
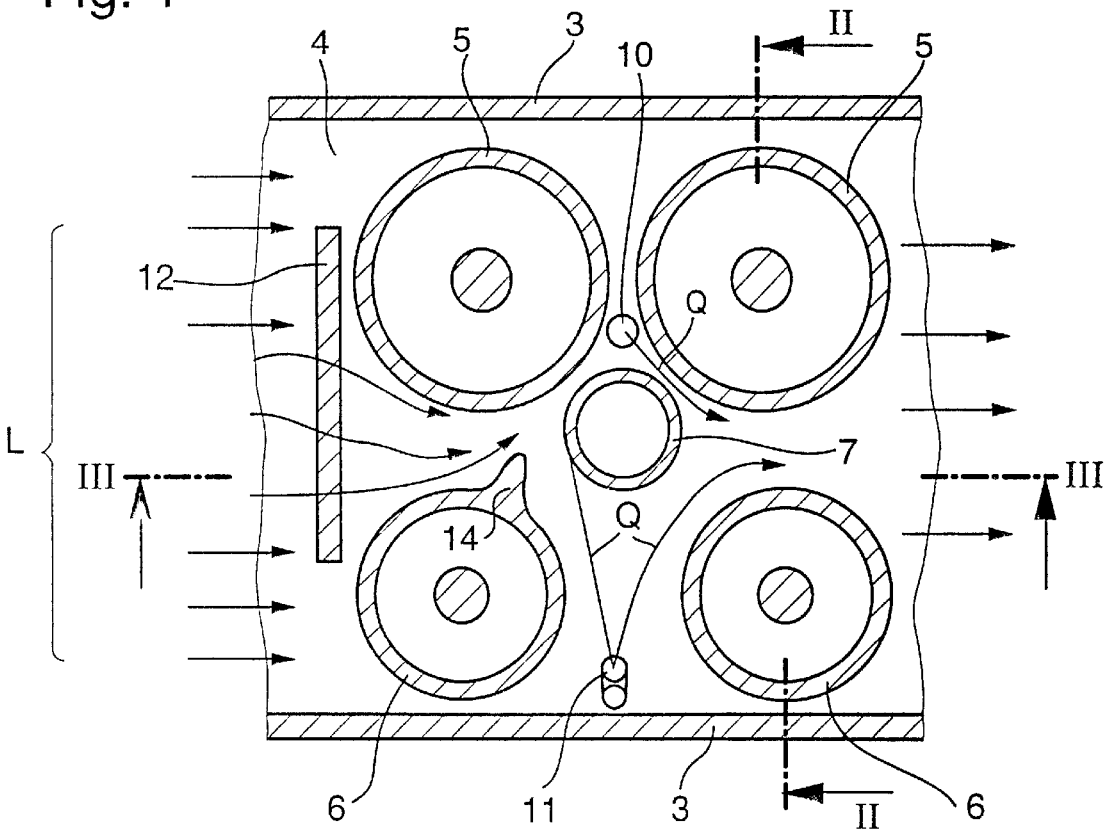
FIG. 1 is a partial cross-sectional view of the cylinder head of a multi-cylinder internal combustion engine with four valves per cylinder, taken along line 1—1 of FIG. 3.

The cylinder head represented in the drawings includes a bottom wall 1, a top wall 2 and side walls 3, which together delimit a cooling water space 4. At each cylinder two intake passages 5 and two exhaust passages 6 extend through the water space 4 and a well 7 is centrally formed in the cylinder head for receiving a spark plug or a fuel injector.

Figure 3:
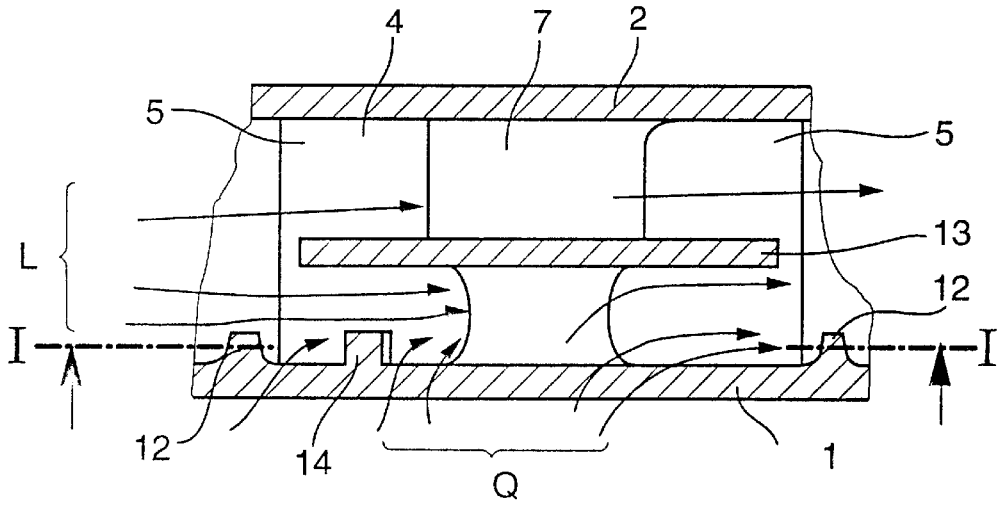
FIG. 3 is a cross-sectional view taken along line 3—3 of FIG. 1.

Cooling water flows through the cooling water space in a longitudinal direction as indicated by the arrows L and, in the area of each combustion chamber 8 also in a transverse direction as indicated by the arrows Q (FIG. 3). The cooling water for the longitudinal flow is admitted at the left-hand end of the cylinder head as shown in FIG. 1 and flows toward the right hand end of the cylinder head from where it is conducted away. The cooling water for the transverse cooling water flow is admitted through the openings between the intake passages 5 and the openings 11 between the exhaust passages 6, which openings are in communication with the cooling water space in the cylinder block. The cooling water of the transverse cooling water flow joins the cooling water of the longitudinal cooing water flow after having passed the areas in the vicinity of the combustion chamber and then flows together with the longitudinal cooling water flow to the right as shown in FIG. 1.

In order to obtain adjacent the cylinder head bottom wall 1 an uninhibited transverse flow and, as a result, effective cooling of the walls next to the combustion chamber and particularly also of the well 7 and the exhaust passage 6, a projection 12 is provided in the longitudinal flow which extends in a transverse direction ahead of the intake and exhaust passages of each cylinder. The projection 12 projects upwardly from the bottom wall 1 into the cooling water space 4. It deflects the longitudinal cooling water flow away from the cylinder head bottom wall 1, thereby preventing stagnant interference where the longitudinal flow would otherwise meet the transverse cooling water flow and would detrimentally affect the heat removal. Adjacent the combustion chambers the deflected longitudinal cooling water consequently flows at a distance from the cylinder head bottom wall. However, since the longitudinal flow is not separated by a wall from the transverse flow, which at this point passes under the longitudinal flow, the two flows are in contact so that no stagnant areas can develop between the two flows.

In order to achieve a particularly good cooling effect around the well 7 in the vicinity of the combustion chamber, the well 7 is surrounded by a plate 13, which is disposed above the projection 12 and extends parallel to the cylinder head bottom wall 1. The plate 13 prevents an excessively rapid upward flow of the transverse cooling water flow without preventing the water of the longitudinal cooling water flow to flow around the well 7. In addition, a guide structure 14 is provided in the longitudinal cooling water flow ahead of the well 7 which, in the embodiment shown, is cast onto the exhaust passage 6. As shown in FIG. 1, the guide structure 14 directs a part of the cooling water of the longitudinal flow around the well 7. The guide structure 14 also provides guidance for the cooling water of the transverse flow exiting from the supply opening 11. Since the exhaust passages 6 are generally smaller than the intake passages 5 and are therefore at a greater distance from one another the cross section of the supply opening 11 can be greater than the cross-section of the supply opening 10 between the intake passages 6. As a result, a greater part of the cooling water of the transverse flow enters through the openings 11 into the cooling water space 4, and particularly intensely cools the thermally highly loaded areas of the cylinder head bottom wall between the exhaust passages the areas of the exhaust passages and of the wells in the vicinity of the cylinder head bottom wall.

Figure 2:
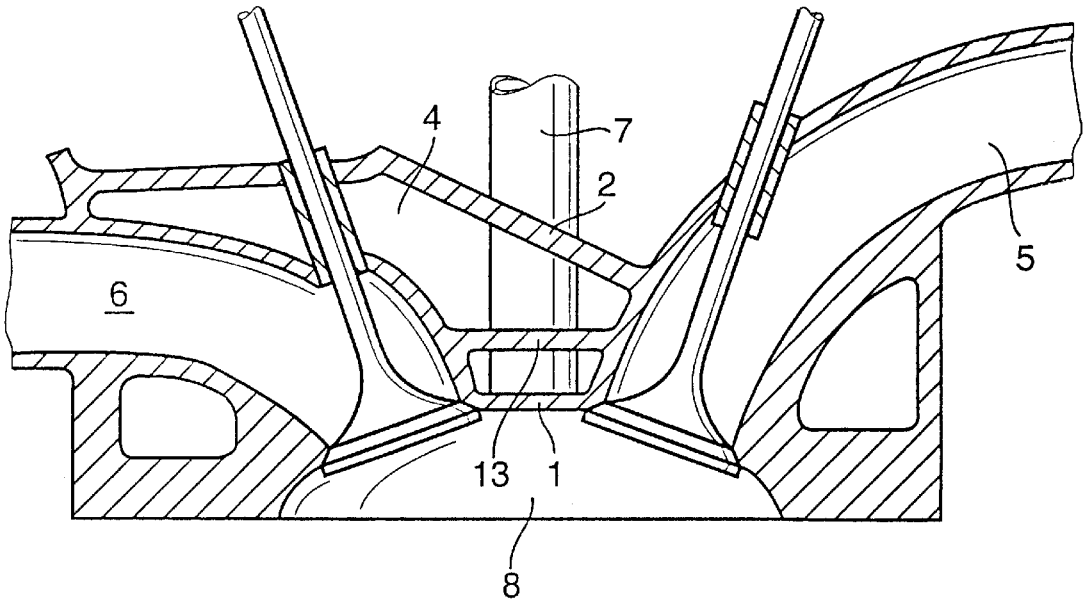
FIG. 2 is a cross-sectional view taken along line 2—2 of FIG. 1.

In a preferred embodiment of the invention, the exhaust side of the cylinder head is cooled in that the cylinder head top wall is lowered toward the intake side as can be seen in FIG. 2.

In this way, the thermally highly loaded exhaust side receives better cooling than the intake side.

What is claimed is:

1. A cylinder head of a multi-cylinder internal combustion engine having bottom-top-and side walls delimiting therebetween a cooling water space and including for each cylinder a number of intake and exhaust passages and a well for receiving a spark plug or a fuel injector extending through said cooling water space through which cooling water flows generally in a longitudinal direction, said cylinder head bottom wall including cooling water supply openings disposed at a side of said cooling water space so as to generate a transverse cooling water flow along said bottom wall and a projection arranged in a transverse direction ahead of each cylinder and extending upwardly so as to lift the cooling water flowing through said cooling water space in longitudinal direction over said transverse projection.

2. A cylinder head according to claim 1, wherein additional cooling water supply openings are arranged in the bottom wall of said cylinder head between adjacent intake and exhaust passages and a flow guide structure is disposed ahead of each well which deflects coolant from the supply opening between said exhaust passage toward and around said well.

3. A cylinder head according to claim 2, wherein said additional cooling water supply openings which are arranged between said exhaust passages have a larger flow cross-section than the additional water supply openings arranged between said intake passages.

4. A cylinder head according to claim 2, wherein said flow guide structure is cast onto an exhaust passage disposed upstream of said well.

5. A cylinder head according to claim 1, wherein a plate is disposed in said cooling water space above each cylinder around said well so as to extend parallel to said cylinder bottom in spaced relationship therefrom.

* * * * *